US007296875B2

(12) United States Patent
Chiu et al.

(10) Patent No.: US 7,296,875 B2
(45) Date of Patent: Nov. 20, 2007

(54) CLEANING DEVICE FOR INK-JET PRINTERS

(75) Inventors: Wan-Wen Chiu, Fongyuan (TW); Kevin Cheng, Yuanli Township, Miaoli County (TW); Jane Chang, Cyonglin Township, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 354 days.

(21) Appl. No.: 11/177,338

(22) Filed: Jul. 11, 2005

(65) Prior Publication Data

US 2006/0139398 A1 Jun. 29, 2006

(30) Foreign Application Priority Data

Dec. 23, 2004 (TW) ..... 93140291 A

(51) Int. Cl.
*B41J 2/165* (2006.01)

(52) U.S. Cl. ..... 347/33

(58) Field of Classification Search ..... 347/33, 347/37

See application file for complete search history.

(56) References Cited

U.S. PATENT DOCUMENTS 6,761,428 B2 * 7/2004 Agarwal et al. ..... 347/33
2004/0041880 A1 * 3/2004 Ikeda et al. ..... 347/37

* cited by examiner

*Primary Examiner*—Julian D. Huffman
*Assistant Examiner*—Jennifer M Baer
(74) *Attorney, Agent, or Firm*—Bacon & Thomas, PLLC

(57) ABSTRACT

A cleaning device is mounted on either of the sides of an ink-jet printer. The cleaning device uses the power source of a paper delivering motor to transmit power to the cleaning units so that the cleaning units rotate to perform cleaning and scrubbing operations for an ink-jet print head. When the printer performs printing operations, the paper delivering motor is used to deliver paper without causing an interference with the ink-jet print head during the printing operation. When the ink-jet print head needs to be cleaned, an ink carriage moves to be opposed to the cleaning device under the ink carriage, then, the paper delivering motor supplies power to drive an external transmission device set. The external transmission device set drives the cleaning device on the revolving seat to rotate so as to clean the ink-jet print head of the ink carriage.

16 Claims, 5 Drawing Sheets

CLEANING DEVICE FOR INK-JET PRINTERS

BACKGROUND OF THE INVENTION

1. Field of the Invention

The present invention relates to a cleaning device for printers and, more particularly, to a cleaning device suited for an ink-jet print head of an ink-jet printer.

2. Description of Related Art

Conventional ink-jet printers are prone to have ink become built up on the surface of the ink-jet print head during printing operations. Thus, the build up causes the surface of the ink-jet print head to become tainted, resulting in improper printing whereby documents may be scrapped, thereby causing waste in time, money and effort. Thus, it is necessary to frequently perform cleaning operations so as to remove the residual ink from the ink-jet print head to avoid the clogging of the ink-jet print head and impaired printing operations. In this connection, a cleaning device set is required for the ink-jet print head to perform the cleaning operations. The cleaning device has a wiper for removing ink, foreign matter etc from the ink-jet print head. However, an additional power source for driving the cleaning device is required for the conventional printers when the cleaning device performs the cleaning operations for the ink-jet print head. In general, a motor is added so that the power of the motor is used to drive the wiper of the device for cleaning the ink-jet print head. As such, the size and the weight of the ink-jet printer increase. It is therefore very difficult to reduce the size of the conventional ink-jet printers. Also, the addition of the motor increases the manufacturing costs of the ink-jet printers. In this light, the conventional ink-jet printers cannot overcome those disadvantages of additional power source, complex mechanism and larger occupied space, and thus, need to be improved.

Therefore, it is desirable to provide an improved cleaning device for ink-jet printers to mitigate and/or obviate the aforementioned problems.

SUMMARY OF THE INVENTION

A primary object of the present invention is to provide a cleaning device for ink-jet printers so as to employ a paper delivering motor to serve as the power source to reduce the manufacturing costs and the space being occupied by the printer and simplify the design of the mechanism of the printer without using any additional power source.

To attain the aforesaid object, a cleaning device for ink-jet printers according to the present invention comprises a chassis having two pivot bases coaxially mounted on the opposing sides of the chassis, respectively; an acting block pivotally mounted between the two pivot bases of the chassis, including a body and two elongate levers in which the body has an upper inclined plane including an elevated portion and a lower portion and the two elongate levers extend in parallel with each other from both sides of the body and include two central pivot regions and two outer pivot regions in which the two central pivot regions are coaxially mounted in the middle section of the two elongate levers respectively for being adapted to the corresponding two pivot bases of the chassis in a pivotal manner; a revolving seat including at least one support and two pivot ends mounted on both ends of the revolving seat respectively and pivotally disposed in the corresponding two outer pivot regions of the acting block respectively, in which one of the pivot ends has a driven roller fixedly mounted on the outer end thereof, and at least one cleaning unit assembled in the at least one support on the revolving seat.

According to the aforesaid cleaning device for ink-jet printers, a stop is selectively mounted on the elevated portion of the inclined plane of the body.

According to the aforesaid cleaning device for ink-jet printers, an external transmission device set for driving the driven roller of the revolving seat to rotate is further included. The external transmission device set includes a driving roller coaxially connected to a paper delivering roller for rotation.

According to the aforesaid cleaning device for ink-jet printers, the external transmission device set further includes an idle roller.

According to the aforesaid cleaning device for ink-jet printers, the idle roller is movably connected between the driving roller and the driven roller of the revolving seat.

According to the aforesaid cleaning device for ink-jet printers, the driven roller is driven by means of the external transmission device set so that the revolving seat rotates with respect to the two elongate levers.

According to the aforesaid cleaning device for ink-jet printers, the slope of the inclined plane of the body is non-linear. Nevertheless, the slope of the inclined plane of the body may be linear.

According to the aforesaid cleaning device for ink-jet printers, it is preferable for the revolving seat to move in parallel with the movement of an ink carriage.

According to the aforesaid cleaning device for ink-jet printers, the chassis preferably includes an ink collection device for removing residue ink on the at least one cleaning unit. In the present invention, the cleaning unit of the ink collection device may be a wiper or a sponge.

According to the aforesaid cleaning device for ink-jet printers, the ink collection device further includes at least one wiper.

According to the aforesaid cleaning device for ink-jet printers, the driven roller can be a conventional one, preferably a driven gear. The external transmission device set is preferably an external gear unit. The driving roller is preferably a driving gear. The idle roller is preferably an idle gear.

According to the aforesaid cleaning device for ink-jet printers, at least one spring assembled between the least one cleaning unit and the at least one support of the revolving seat is further included.

According to the aforesaid cleaning device for ink-jet printers, the cleaning unit can be any conventional wiper, preferably a wiper or a scrubbing sponge.

According to the aforesaid cleaning device for ink-jet printers, the two pivot bases of the chassis include a pivot aperture, and also, the central pivot regions of the two elongate levers are preferably two pivotal axes.

According to the aforesaid cleaning device for ink-jet printers, the two outer pivot regions of the two elongate levers are preferably two outer holes, and also, the two pivot ends of the revolving seat are preferably two shafts.

According to the aforesaid cleaning device for ink-jet printers, the stop of the body is preferably an indentation, and also, the holding member of the ink carriage is preferably a protrusion.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
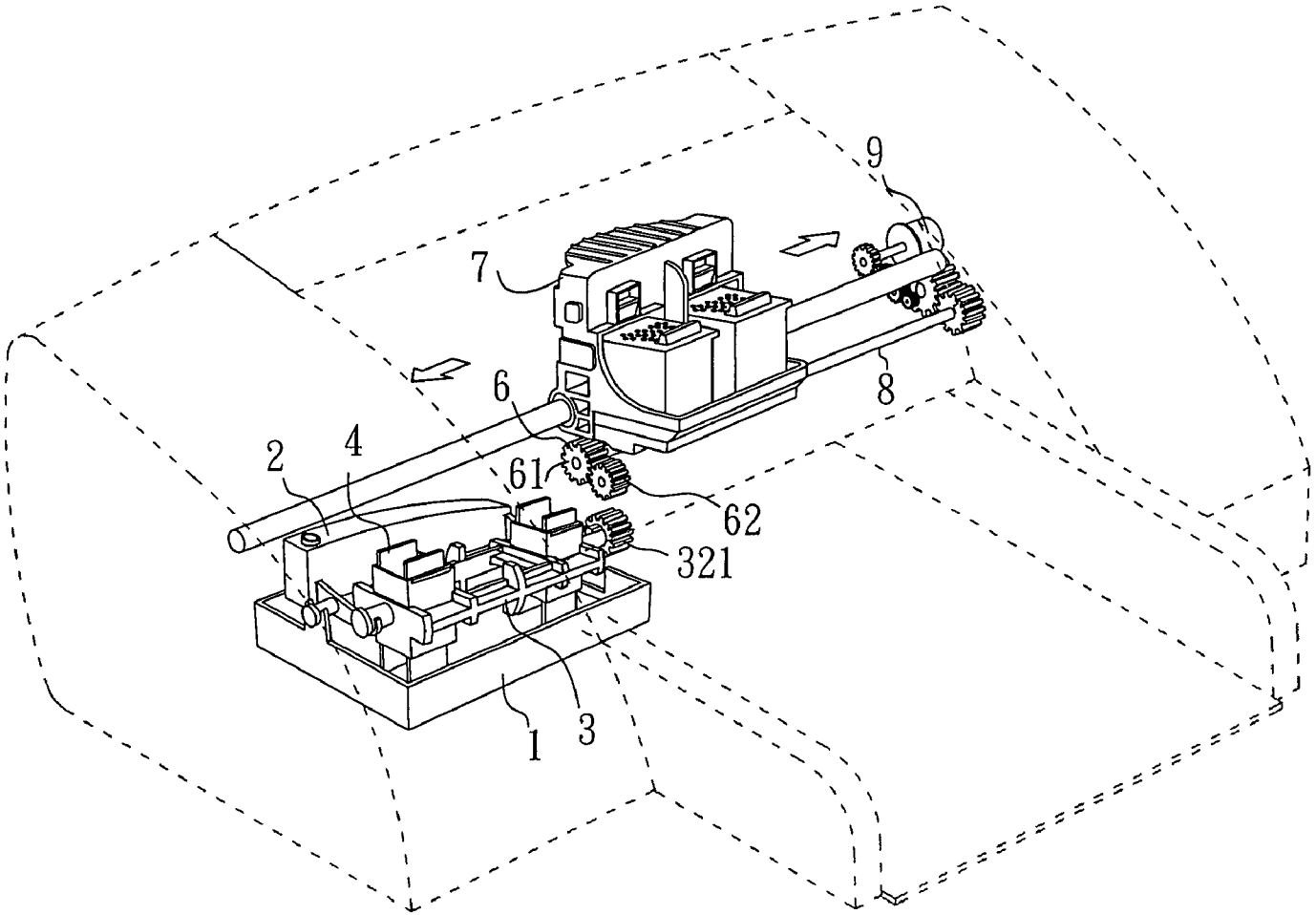
FIG. 1 is a schematic diagram of a cleaning device for ink-jet printers according to a preferred embodiment of the present invention.

Referring to FIG. 1, a preferred embodiment of a cleaning device for ink-jet printers is disclosed. FIG. 1 is a schematic diagram of the cleaning device for ink-jet printers according to a preferred embodiment of the present invention. In this preferred embodiment, a cleaning device set is mounted on one of the inner sides of an ink-jet printer, and comprises a chassis 1, an acting block 2, a revolving seat 3 and a plurality of cleaning units 4. In addition, the printer includes an external transmission device set 6, an ink carriage 7, a paper delivering roller 8 and a paper delivering motor 9. The external transmission device set 6 further includes a driving roller 61 and an idle roller 62, being coaxially connected to the paper delivering roller 8 for rotation. In this embodiment, the external transmission device set 6 is an external transmission gear set 6. The driving roller 61 is a driving gear in this embodiment. The idle roller 62 is an idle gear in this embodiment. The cleaning unit 4 is a wiper in this embodiment.

In cleaning operations for the printer, the paper delivering roller 8 is driven by the power source of the paper delivering motor 9 so as to deliver paper, and also, the external transmission device set 6 is driven by the paper delivering roller 8 so as to rotate. In the printing operation of the printer, the cleaning device is disconnected from the external transmission device set 6 without interfering with the printing operation of the printer.

Figure 2:
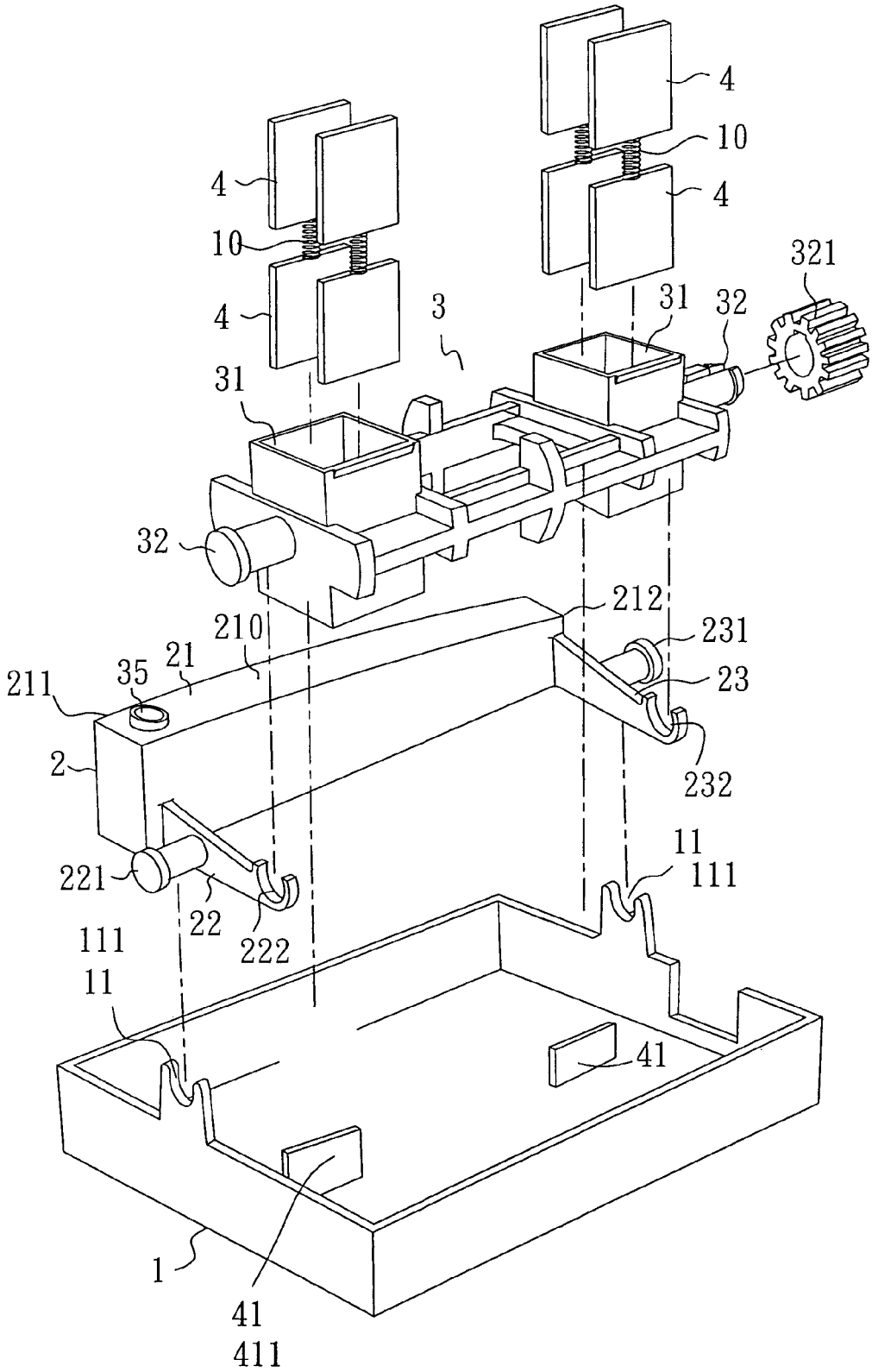
FIG. 2 is an exploded diagram of the structure of a cleaning device for ink-jet printers according to a preferred embodiment of the present invention.

Referring to FIG. 2, an exploded diagram of the structure of the cleaning device for ink-jet printers according to the present invention is illustrated. As described above, the cleaning device of the ink-jet printer comprises the chassis 1, the acting block 2, the revolving seat 3 and the plurality of cleaning units (wipers) 4. The chassis 1 includes two pivot bases 11 coaxially mounted on the opposing sides of the chassis 1, respectively. The two pivot bases 11 include a pivot aperture 111. In addition, the chassis 1 further includes two ink collection device 41. In this preferred embodiment, the ink collection device 41 includes at least one wiper 411 for removing ink on the cleaning unit 4.

Furthermore, the acting block 2 is pivotally mounted between the two pivot bases 11 of the chassis 1. The acting block 2 includes a body 21 and two elongate levers 22, 23. The body 21 has an upper inclined plane 210 including an elevated portion 211 and a lower portion 212. In this embodiment, the slope of the inclined plane 210 is a non-linearly curved surface or a linearly wedged surface. Moreover, in this embodiment, the elevated portion 211 of the inclined plane 210 has a stop 35 for holding the ink carriage 7 in position. The two elongate levers 22, 23 extend outwardly and in parallel with other from two opposed ends of the body 21 toward the same direction, respectively. The two elongate levers 22, 23 include two central pivot regions 221, 231 and two outer pivot regions 222, 232. The two central pivot regions 221, 231 are coaxially disposed in the middle section of the two elongate levers 22, 23, respectively, and pivotally mounted on the corresponding two pivot bases 11 of the chassis 1.

The revolving seat 3 includes at least one support 31 and two pivot ends 32 mounted respectively at two ends of the revolving seat 3 and pivotally received in the corresponding two outer pivot ends 222, 232 of the acting block 2 respectively. A driven roller 321 is fixedly mounted on the outer end of one of the pivot ends 32. Furthermore, the cleaning unit 4 of this embodiment is assembled in the at least one support 31 of the revolving seat 3. At least one spring 10 is disposed between the cleaning unit 4 and the support 31 of the revolving seat 3. The spring 10 provides a preset tension to urge the cleaning unit 4 against the ink-jet print head 72 of the ink carriage 7 with an appropriate acting force for the cleaning operations.

Figure 3:
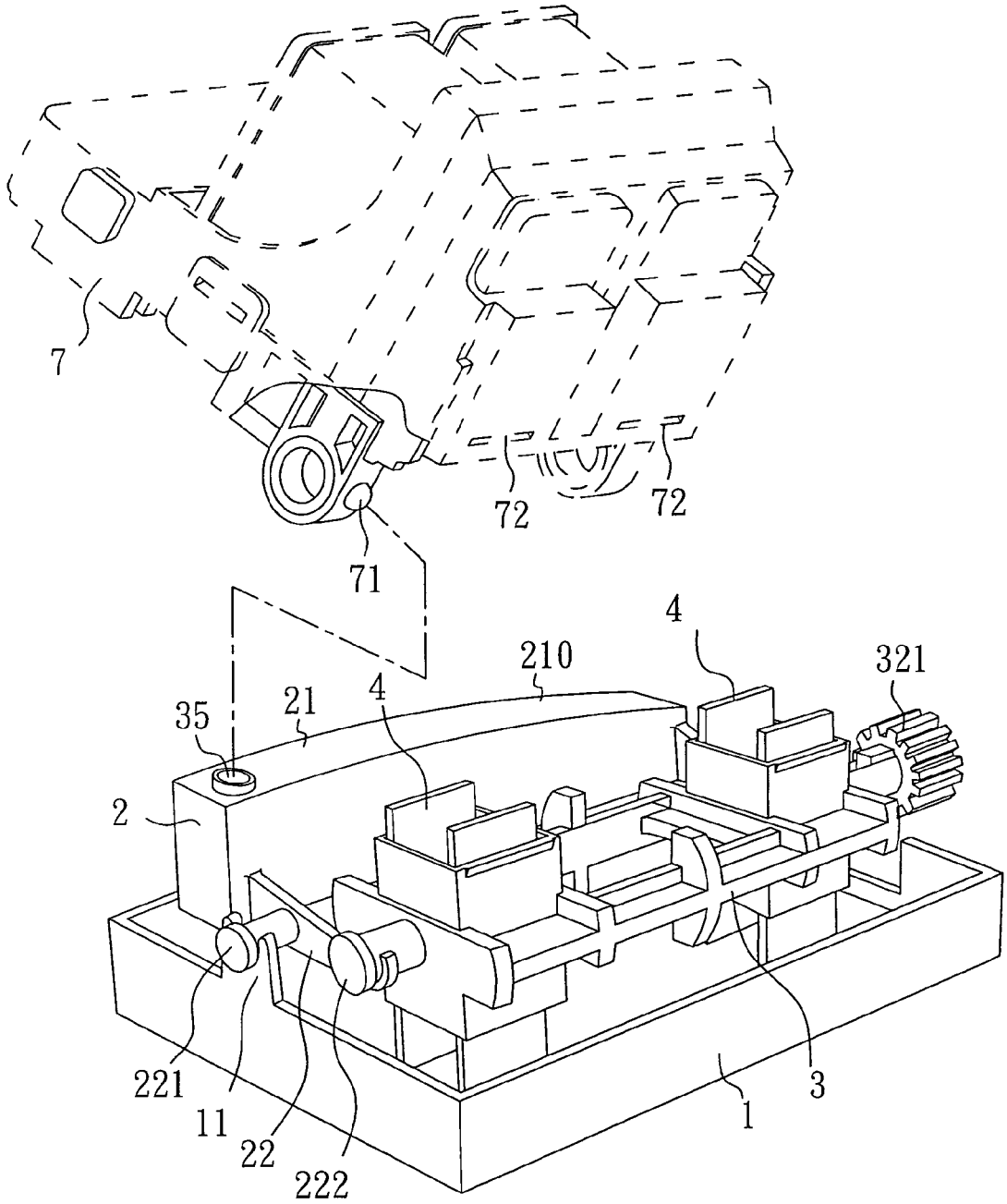
FIG. 3 illustrates an assembly of a cleaning device for ink-jet printers according to a preferred embodiment of the present invention.

Referring to FIG. 3, an assembly of the cleaning device for ink-jet printers according to the present invention is illustrated. As shown, when the ink carriage 7 stops to be opposed to the cleaning device under the ink carriage 7, the cleaning device is used to clean the print head 72 of the ink carriage 7. In FIG. 3, a holding member 71 is disposed on the lower edge of the ink carriage 7 so as to hold the ink carriage 7 and the cleaning device in position during cleaning operations.

Figure 4A:
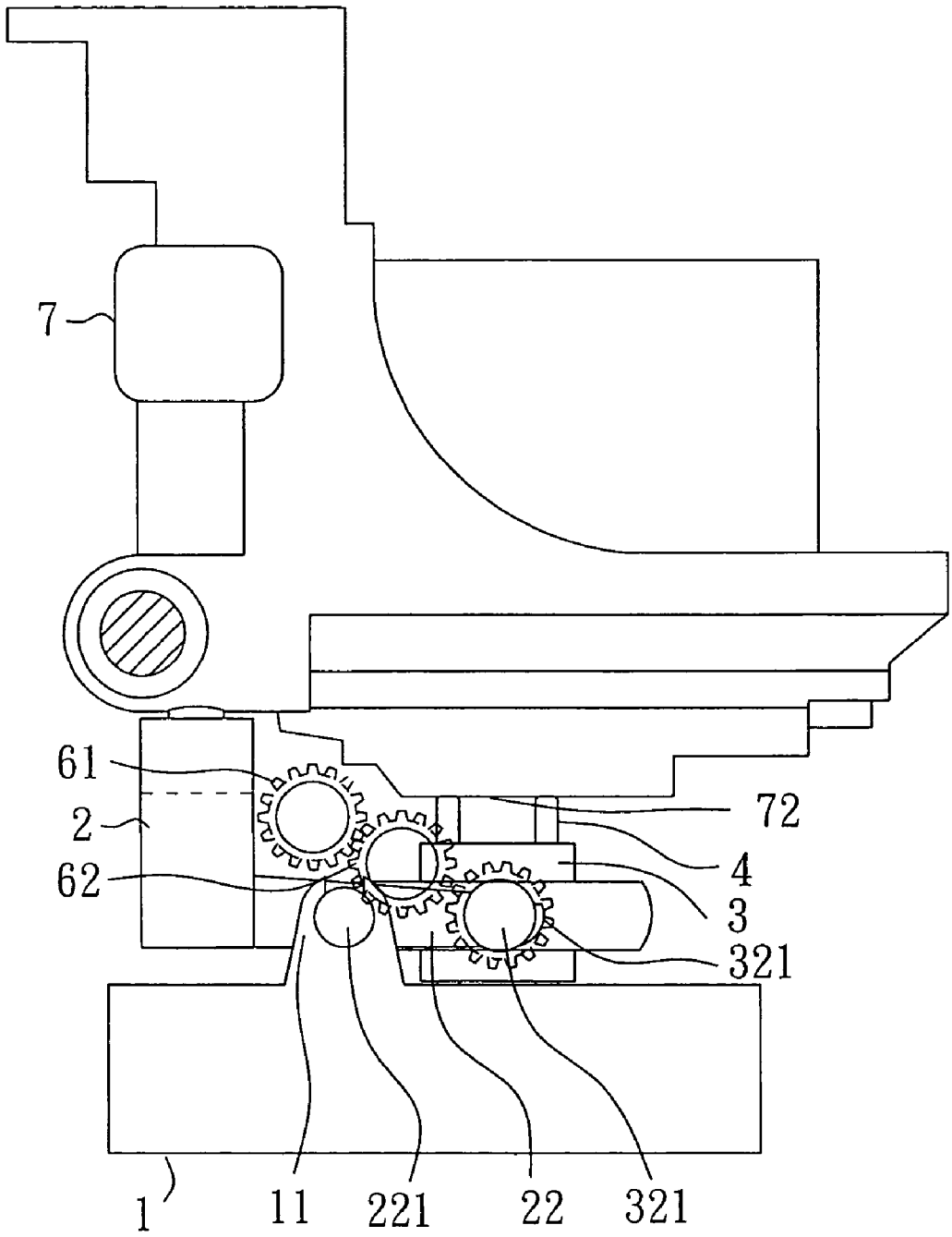
FIG. 4*a* is a schematic diagram illustrating a cleaning device disconnected with a print head according to a preferred embodiment of the present invention.
Figure 4B:
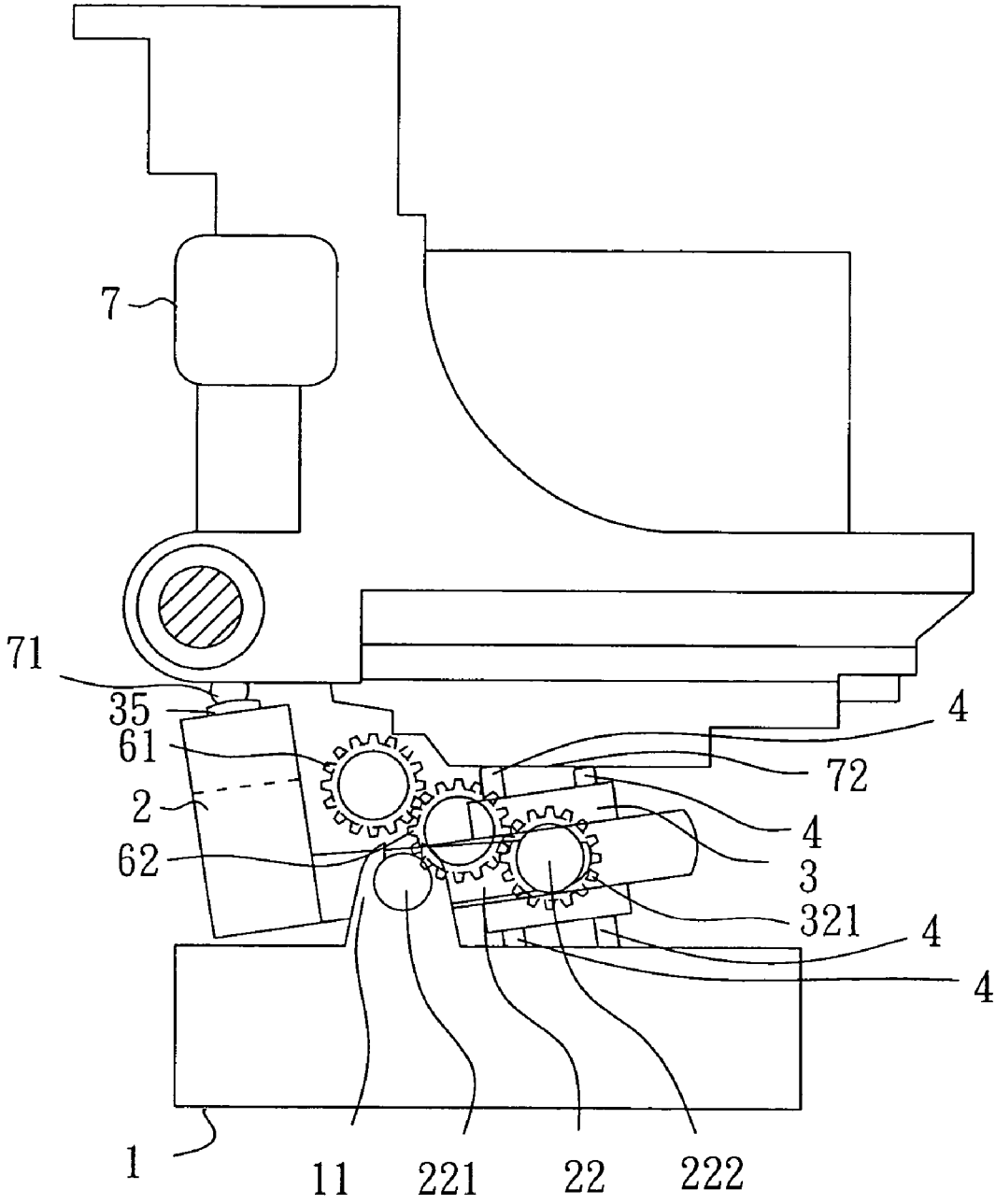
FIG. 4*b* is a schematic diagram illustrating a cleaning device connected to a print head according to a preferred embodiment of the present invention.

The cleaning device of the ink-jet printer operates in sequence as schematically illustrated in FIGS. 4*a* and 4*b*. As shown in FIG. 4*a*, when the printer is printing paper, the ink carriage 7 is positioned at the lower portion 212 of the inclined plane 210 of the body 21 without contacting the inclined plane 210 of the body 21, and also, the driven roller 321 of the revolving seat 3 does not engage the idle roller 62 of the external transmission device set 6. Hence, there is no interference between the cleaning device and the ink carriage 7, which thus moves along the predetermined processing path.

To maintain the print quality of the printer, it is necessary to frequently perform the cleaning operations for the print head 72 to avoid the build-up of the resident ink. The related operations are illustrated in FIGS. 1 and FIGS. 2. The cleaning device of this embodiment operates when the print head 72 of the ink carriage 7 needs to perform the cleaning operations. As shown in FIG. 4*b*, the paper delivering motor 9 stops rotation, and then, the ink carriage 7 moves toward the cleaning device. When the ink carriage 7 moves and comes near the cleaning device, the holding member 71 on the lower edge of the ink carriage 7 moves from the lower portion 212 toward the elevated portion 211 of the inclined plane 210 of the body 21 of the acting block 2. As a result, the holding member 71 of the ink carriage 7 is correspondingly positioned at the stop 35 on the inclined plane 210 of the body 21 so as to hold the ink carriage 7 in position.

When the ink carriage 7 presses the acting block 2 downwardly, the acting block 2 starts to rotate about the central pivot regions 211, 231 so as to drive the outer pivot regions 222, 232 to move upwardly. Thus, the driven roller 321 of the revolving seat 3 is driven to move so that the external transmission device set 6 is engaged with the driven roller 321 of the revolving seat 3.

After the transmission device set 6 is engaged with the driven roller 321 of the revolving seat 3, the paper delivering motor 9 starts to rotate again so as to drive the paper delivering roller 8 to rotate. Also, both the external transmission device set 6 and the driven roller 321 of the revolving seat 3 are driven by means of the paper delivering roller 8. At this moment, the pivot ends 32 are driven to rotate by the driven roller 321 because the external transmission device set 6 is driven, and thus, the cleaning unit 4 disposed on the revolving seat 3 is driven to rotate by the driven roller 321. The revolving seat 3 moves in parallel with the ink carriage 7 to clean the print head 72 of the ink-jet printer. Neither damage to the print head 72 nor mixing of colors occurs by such a scrubbing action so as to ensure print quality.

When the cleaning operations are completed, the paper delivering motor 9 stops rotation, and also, the holding member 71 of the ink carriage 7 is disengaged from the stop 35 on the inclined plane 210 of the body 21 by the moving momentum. Hence, the ink carriage 7 does not face the cleaning device, and also, the acting block 2 returns to the original position so that the driven roller 321 of the revolving seat 3 is disengaged from the external transmission device set 6. The printer then resumes the normal printing function. A side view of the components positioned relative to one another is shown in FIG. 4*a*. In the cleaning device for ink-jet printers of the present invention, the cleaning device and the paper delivering mechanism adopt the same power source (that is, the motor for supplying power) so as to dispense with an additional motor and power transmission mechanism. Thus, the present invention is capable of reducing the manufacturing cost and the size of the printer and simplifying the design of the mechanism of the printer.

Although the present invention has been explained in relation to its preferred embodiment, it is to be understood that many other possible modifications and variations can be made without departing from the spirit and scope of the invention as hereinafter claimed.

What is claimed is:

1. A cleaning device for ink-jet printers, comprising:

a chassis having two pivot bases coaxially mounted on the opposing sides of said chassis, respectively;

an acting block pivotally mounted between said two pivot bases of said chassis, including a body and two elongate levers wherein said body has an upper inclined plane including an elevated portion and a lower portion and said two elongate levers extend in parallel with each other respectively from two ends of said body and include two central pivot regions and two outer pivot regions wherein said two central pivot regions are coaxially mounted in the middle section of said two elongate levers respectively for being adapted to the corresponding two pivot bases of said chassis in a pivotal manner;

a revolving seat including at least one support and two pivot ends mounted on both ends of said revolving seat respectively and pivotally disposed in the corresponding two outer pivot regions of said acting block respectively, wherein one of said pivot ends has a driven roller fixedly mounted on the outer end thereof; and at least one cleaning unit assembled in said at least one support on said revolving seat.

2. The cleaning device for ink-jet printers of claim 1, wherein a stop is selectively mounted on said elevated portion of said inclined plane of said body while a holding member is mounted on the lower edge of an ink carriage.

3. The cleaning device for ink-jet printers of claim 2, wherein said revolving seat moves in parallel with the movement of said ink carriage.

4. The cleaning device for ink-jet printers of claim 2, wherein said stop of said body is an indentation, and said holding member of said ink carriage is a protrusion.

5. The cleaning device for ink-jet printers of claim 1, wherein an external transmission device set including a driving roller coaxially connected to a paper delivering roller for rotation is further included for driving said driven roller of said revolving seat to rotate.

6. The cleaning device for ink-jet printers of claim 5, wherein said external transmission device set further includes an idle roller movably connected between said driving roller and said driven roller of said revolving seat.

7. The cleaning device for ink-jet printers of claim 6, wherein said driven roller is a driven gear, said external transmission device set is an external gear unit, said driving roller is a driving gear, and said idle roller is an idle gear.

8. The cleaning device for ink-jet printers of claim 5, wherein said driven roller is driven by means of said external transmission device set so that said revolving seat rotates with respect to said two elongate levers.

9. The cleaning device for ink-jet printers of claim 1, wherein the slope of said inclined plane of said body is non-linear.

10. The cleaning device for ink-jet printers of claim 1, wherein said chassis includes an ink collection device for removing ink from said at least one cleaning unit.

11. The cleaning device for ink-jet printers of claim 10, wherein said ink collection device further includes at least one wiper.

12. The cleaning device for ink-jet printers of claim 1, wherein at least one spring assembled between said least one cleaning unit and said at least one support of said revolving seat is further included.

13. The cleaning device for ink-jet printers of claim 1, wherein said two pivot bases of said chassis each include a pivot aperture, and said central pivot regions of said two elongate levers are two pivotal axes.

14. The cleaning device for ink-jet printers of claim 1, wherein said two outer pivot regions of said two elongate levers are two outer holes, and said two pivot ends of said revolving seat are two shafts.

15. The cleaning device for ink-jet printers of claim 1, wherein said cleaning unit is a wiper.

16. The cleaning device for ink-jet printers of claim 1, wherein said cleaning unit is a scrubbing sponge.

* * * * *